US005284507A

United States Patent [19]

Ashton et al.

[11] Patent Number: 5,284,507

[45] Date of Patent: Feb. 8, 1994

[54] WASTE TANK FOR VACUUM SEWAGE SYSTEM

[75] Inventors: Larry J. Ashton, Mapleton, Utah; John F. Sollinger, Newark, Del.

[73] Assignee: E. I. Du Pont de Nemours and Company, Wilmington, Del.

[21] Appl. No.: 967,034

[22] Filed: Oct. 27, 1992

[51] Int. Cl.[5] ..... B01D 19/00

[52] U.S. Cl. ..... 96/195; 96/197; 210/512.1

[58] Field of Search ..... 55/191, 204, 230, 242, 55/274; 210/512.1

[56] References Cited

U.S. PATENT DOCUMENTS

| | | | |
|---|---|---|---|
| 812,855 | 2/1906 | Ljungstrom | 55/205 |
| 3,883,432 | 5/1975 | Hildebrand | 210/195 |
| 4,124,409 | 11/1978 | Gladden | 55/191 |
| 4,910,355 | 12/1988 | Kennedy | 55/191 |
| 5,002,592 | 3/1991 | Stroby et al. | 55/204 |
| 5,026,407 | 6/1991 | Tobey | 55/185 |
| 5,069,783 | 12/1991 | Wang et al. | 210/202 |

*Primary Examiner*—Charles Hart

[57] ABSTRACT

A vacuum waste containment system to operate in situations where limited water is available and discharge of liquid and waste is undesirable. The system is powered by an external vacuum source. The vacuum draws the waste into a holding tank through an air water separator. The majority of the liquid and waste is deposited into the tank while the residual water is separated and drained back into the tank before reaching the vacuum source. The system has been designed for low weight to be reliable and require minimum maintenance.

2 Claims, 3 Drawing Sheets

WASTE TANK FOR VACUUM SEWAGE SYSTEM

BACKGROUND OF THE INVENTION

This invention relates to a waste tank for a vacuum sewage system used in conjunction with aircraft vacuum toilet systems.

As disclosed in U.S. Pat. No. 5,026,407, anyone who has ever made a relatively long flight aboard a commercial passenger jet is probably familiar with their toilets. Flushing these devices results in toilet fluids and solid wastes being drawn from a toilet bowl down a waste line. Unlike conventional toilets, where waste exits the toilet bowl via a circular water flow that carries the waste through a bottom outlet, the toilets in the most recent passenger jet models are vacuum toilets that rely upon suction for removing waste. This creates the familiar sucking sound that accompanies flushing this particular toilet. A common attribute of such systems is that a flushing airflow is created by venting toilets externally of the aircraft. This is accomplished by opening a valve, which creates an airflow path from a given toilet bowl to the outside or ambient atmosphere via a waste line and tank system. The pressure differential between the toilet cabin and the outside is what actually generates the airflow. At certain low elevations, where the pressure differential is not great, a vacuum blower is employed to assist or augment the natural pressure differential between inside and outside the aircraft.

Of course, the solid and liquid waste in the toilet is not simply dumped outside the aircraft. Instead, it is separated from the airflow, and deposited in a waste tank prior to venting the air overboard.

Typically, the airflow and entrained waste travel from the toilet to the waste tank via conventional pipes or lines. The conventional waste tank has one or more waste inlets configured to direct the flow circumferentially in a clockwise direction around the tank's interior, but at a level that is above and parallel to the level of waste already in the tank. As a result, a combination of centrifugal forces and gravity cause separation of much of the entrained matter from the airflow, and it simply drops downwardly into the tank. Some entrained matter remains with the airflow and is removed via a separator as it exits the tank. This device is normally positioned inside the top portion of the tank.

However, when the tank reaches a level approaching the full liquid level of the tank, the kinetic energy of the sewage entering the tank causes splashing and creates waves which interact with the airflow causing more liquid to be entrained in the airflow than can be handled efficiently by the separator. In this case liquid is exhausted to the atmosphere and forms ice on the aircraft exterior which then could break off and cause serious problems when it strikes the ground.

The waste tank system described above has sensors for detecting the level of waste inside the tank. These sensors have faces that are positioned at a certain vertical height along the tank's inner wall, and provide contact with the waste as its level rises. In the full tank condition, the level sensors remove power from all toilets connected to the tank.

The above-described tank inlet arrangement, which creates a circular flow motion inside the tank, also creates a problem in that it tends to coat the waste level sensor faces with solid and liquid waste. This has been known to cause the sensors to emit signals falsely indicating a full tank, resulting in unnecessary shutdown of the toilet. This naturally results in a serious inconvenience for the passengers.

The typical waste tank system also has one or more rinse nozzles that protrude into the tank. These are connectable to an external source of clean water for periodically rinsing and/or cleaning the tank during aircraft maintenance intervals. They also tend to be coated by incoming waste from tank inlets which can clog them.

SUMMARY OF THE INVENTION

A waste tank for a vacuum sewage system according to this invention is defined by a tank having a continuous side wall, a top, a bottom, an inlet for admitting air and sewage tangentially into the tank, and an outlet for exhausting air separated from liquid from the top of the tank. The inlet and outlet are above the maximum liquid filling level in the tank, and a shelf is attached to and extends from the interior surface of the side wall of the tank and is located above said filling level and below said inlet whereby interaction between air being admitted through said inlet and the liquid in the tank is reduced.

The shelf extends partially around the side wall of the tank and is directed downwardly from said inlet.

The waste tank includes a rotary spray nozzle centrally mounted to said top of said tank through which spray liquid is forced and which rotates by the reactive force of the liquid spray ejected from the nozzle, the nozzle being directed toward said side walls.

The tank is formed of a filament wound graphite ribbed structure impregnated with epoxy resin and has an abrasion resistant fluorocarbon polymer coating on its inside surfaces.

The waste tank also includes a frame and means for externally supporting said tank from said frame and sensing the weight of said tank.

DETAILED DESCRIPTION OF THE PREFERRED EMBODIMENT

Figure 1:
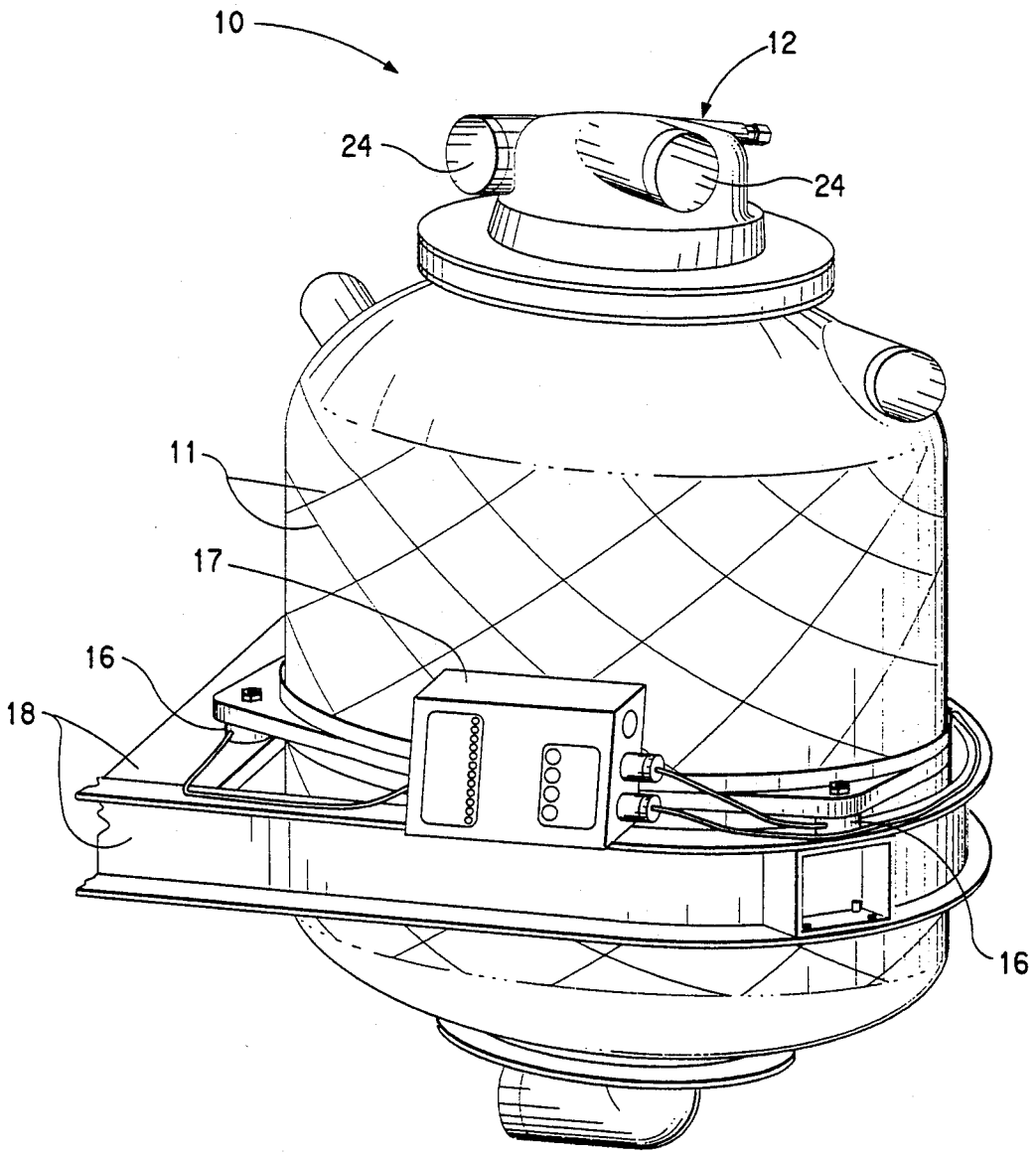
FIG. 1 is a perspective view of the waste tank of this invention.

The embodiment chosen for purposes of illustration as shown in the drawings includes a waste tank generally designated 10, a separator 12, and a weight sensing system 16 supporting waste tank 10 on a frame 18.

The tank 10 is a filament wound, graphite epoxy, autoclaved cured structure. The curing method creates a low void structure allowing the tank wall to be the containment barrier preventing liquid penetration through the tank wall.

There is a coating on the inside of the tank of an abrasion resistant impregnated fluorocarbon resin material. The abrasion resistant material prevents damage to the tank wall when various solid materials enter the tank with waste. The fluorocarbon resin aids in cleaning when the inside of the tank is flushed with clean water. This also reduces the tendency of debris to stick to the walls of the tank.

The tank has integrally wound ribs 11. Since the system works on vacuum, the ribs increase the buckling resistance of the tank at a minimum weight penalty. Also the graphite epoxy structure is designed to work at a very low stress level yielding excellent fatigue life.

Figure 2:
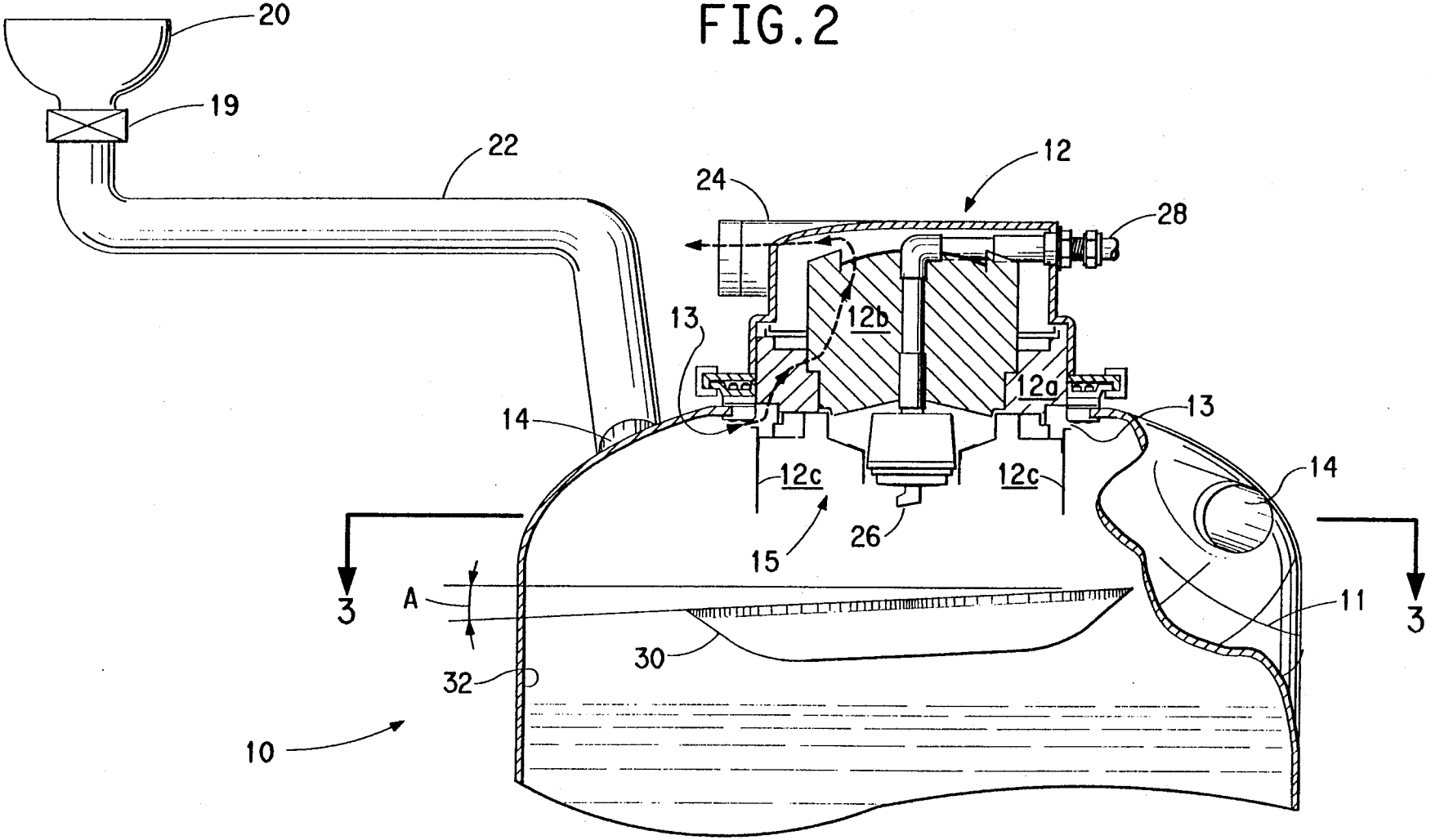
FIG. 2 is a side elevation view partially in cross section of a waste tank showing the tank connected to a toilet bowl.
Figure 3:
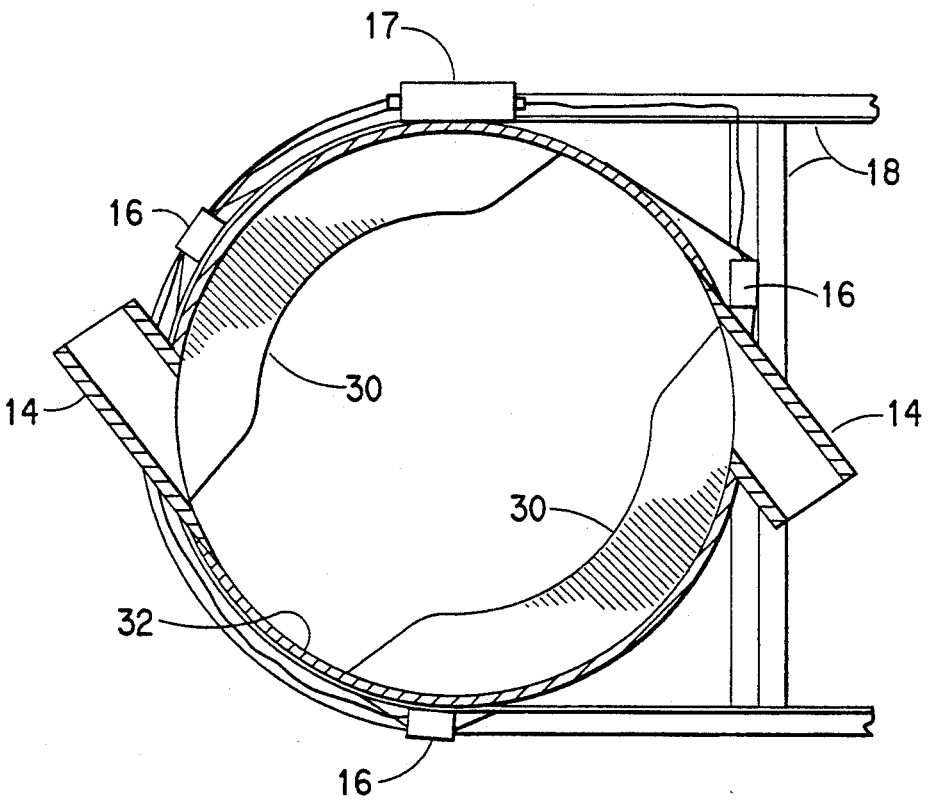
FIG. 3 is a transverse cross section of the tank of FIG. 2 taken along lines 3—3.

As best shown in FIGS. 2 and 3, the vacuum waste system includes a toilet 20 connected to the tangential inlet 14 of tank 10 by a waste line 22. The toilet is flushed by opening valve 19 at the bottom of the toilet bowl which creates an air flow passage from the toilet 20 to a vent outlet 24. Solid and liquid waste inside the toilet is drawn through the waste line 22 into tank 10 by the pressure differential between the aircraft cabin and the pressure outside the aircraft. The system may be provided with a blower (not shown) that assists the creation of an airflow at lower elevations where there is not much difference between cabin pressure and pressure outside the aircraft.

A separator device 12 is shown mounted to the top of tank 10 above the full liquid level of the tank. The separator includes dual filters 12*a* and 12*b* and incorporates through passages from air intake inlet 13 of the separator to outlet or vent 24. A skirt 12*c* isolates inlet 13 from the drain area 15 of the separator which reduces the possibility of any separated drainage liquid being picked up by the inlet air and being recycled through the separator.

A rotary spray cleaning nozzle 26 is centrally mounted to the top of the tank and is connected to pressurized liquid source through passage 28 through which spray liquid is forced from a source not shown. The spray nozzle is rotated by the reactive force of the liquid spray ejected from nozzle which allows the interior of the tank 10 to be cleaned because the interior surface of the tank is subject to the liquid spray.

A shelf 30 is attached to the interior of sidewall 32 of tank 10 and extends into the tank from the sidewall. The shelf is located above the maximum filling level of the tank and below the tangential inlet 14 of the tank, extends partially around the sidewall and is directed downwardly at an angle A from a line parallel to the centerline of tangential inlet 14.

In operation, the air and sewage enters through tangential inlet 14 into tank 10 and falls to shelf 30 which provides the initial separation of liquid and solids from the air, i.e. the liquid and solids flow off the shelf into the tank and the air with some entrained moisture is directed to the separator inlet 13 of separator 12 and does not interact with the liquid in the tank.

The weight sensing system incorporates three 5,000 pound load cells 16 (Sensotec model 31) supporting waste tank 10 from frame 18. Thus the sensing system is located externally to the tank.

The output of the load cells after conditioning goes through a microprocessor 17 to a readout. The microprocessor not only integrates and averages the weight, it tares out any acceleration effect from the system accelometer. The system will read the percentage full at remote locations and at the emptying station. This will allow a check before use. The design will tare the system weight so any weight build up in the tank will be shown on the readout of the microprocessor.

What is claimed is:

1. A waste tank for a vacuum sewage system for serving the sanitation needs of aircraft passengers and crew, said tank having a continuous side wall, a top, a bottom, an inlet for admitting air and sewage tangentially through the side wall of the tank, and an outlet for exhausting air from the top of the tank, said inlet and outlet being above the maximum liquid filling level in the tank, and a shelf attached to and extending from said side wall, said shelf extending partially around said side wall and being directed downwardly from said inlet said shelf being located above said filling level and below said inlet whereby interaction between air being admitted through said inlet and the liquid in the tank is reduced said waste tank including a rotary spray nozzle centrally mounted to said top of said tank through which spray liquid is force and which rotates by the reactive force of the liquid spray ejected from the nozzle, said nozzle being directed toward said side walls and waste tank including a means for separating entrained liquid from air located in the top of the tank said tank being formed of a filament wound graphite ribbed structure impregnated with epoxy resin, there being an abrasion resistant fluorocarbon resin coating the inside surfaces of said tank.

2. The waste tank of claim 1 including a frame and means for externally supporting said tank from said frame and sensing the weight of said tank.

* * * * *